United States Patent [19]

Neau et al.

[11] 4,067,590

[45] Jan. 10, 1978

[54] SAFETY SKI BINDING

[75] Inventors: Alain Neau, Thyez; Jean-Marie Begey, Cluse, both of France

[73] Assignee: Garcia Corporation, Teaneck, N.J.

[21] Appl. No.: 700,153

[22] Filed: June 28, 1976

[30] Foreign Application Priority Data

July 8, 1975 France ..... 75.21391

[51] Int. Cl.[2] ..... A63C 9/08

[52] U.S. Cl. ..... 280/626

[58] Field of Search ..... 28/626, 618

[56] References Cited

U.S. PATENT DOCUMENTS

| | | | |
|---|---|---|---|
| 3,249,365 | 3/1966 | Beyl | 280/626 |
| 3,964,759 | 6/1976 | Solomon | 280/626 |
| 3,970,326 | 7/1976 | Solomon | 280/626 |

FOREIGN PATENT DOCUMENTS

| | | | |
|---|---|---|---|
| 1,536,916 | 3/1965 | France | 280/626 |
| 1,428,879 | 2/1970 | Germany | 280/626 |

*Primary Examiner*—Robert R. Song

*Attorney, Agent, or Firm*—Fitzpatrick, Cella, Harper & Scinto

[57] ABSTRACT

A safety ski binding comprises a stirrup mounted to a ski or a sole-plate. Articulated to the stirrup is a toggle mechanism including a spring biased holding member arranged to engage the edge of the sole of a ski boot. The holding member is displaceable in a direction toward the toggle to release the boot upon application of a predetermined minimum separating stress.

8 Claims, 8 Drawing Figures

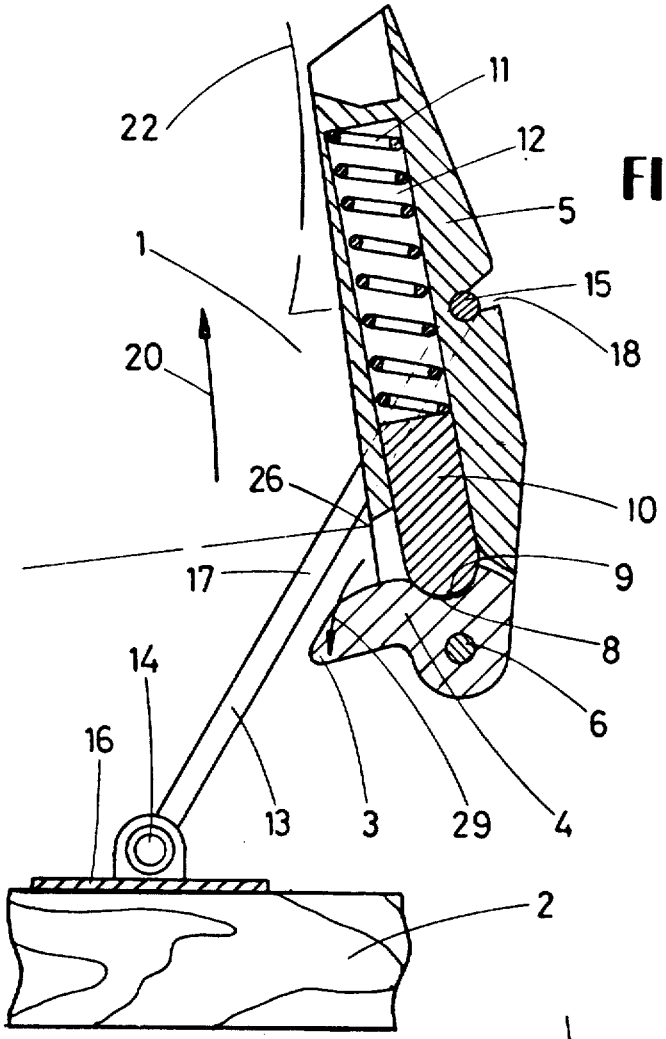
FIG. 3
FIG. 4
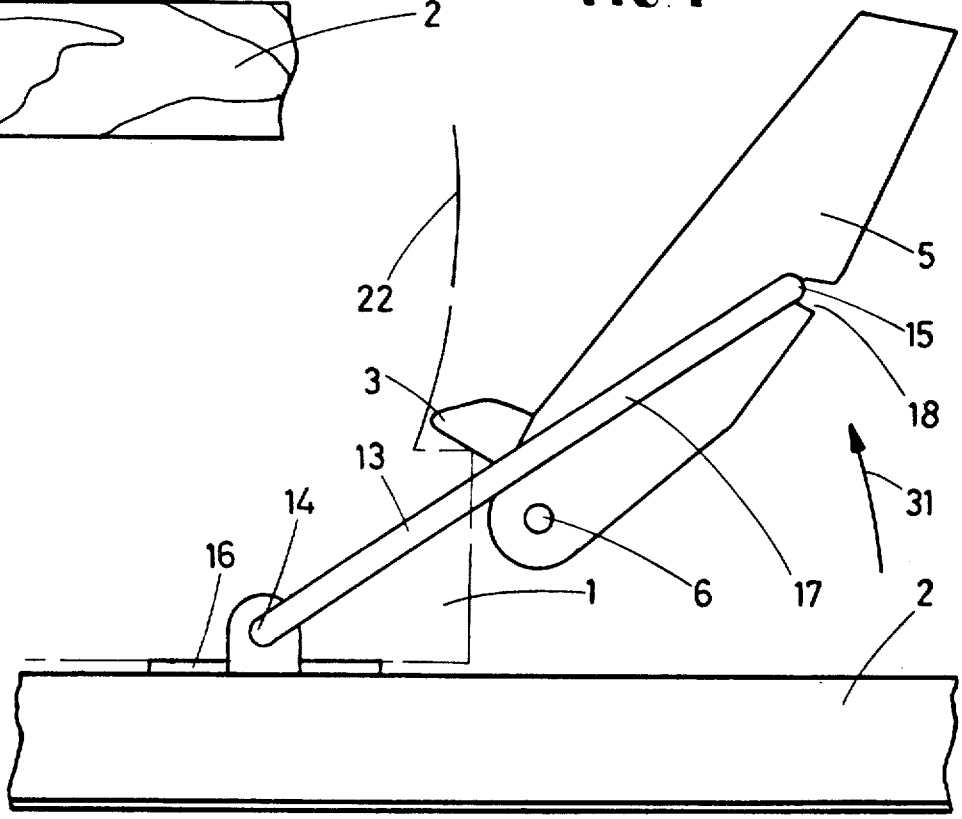

SAFETY SKI BINDING

BACKGROUND OF THE INVENTION

The present invention relates generally to safety ski bindings and more particularly to a safety ski binding of the type having a movable holding member supporting a sole gripping element adapted to engage the edge of one end of a ski boot sole and maintain the sole against the ski or an intermediate plate during skiing but to permit release of the boot upon a predetermined minimum separating stress.

In known fastenings of this kind, such as that described in French Pat. No. 1,435,230, the movable member supporting the sole hold travels along the lengthwise axis of the elastic means. As a result, the ratio between the required release effort and the opposing force of the biasing means is approximately equal to 1 thus necessitating the presence of comparatively strong and therefore bulky biasing means. Moreover, any necessary adjustment of the tension requires a likewise comparatively heavy and bulky device.

The safety binding according to the present invention serves to avoid this disadvantage by providing a ratio greater than 1 between the effort required for release and the opposing force of the biasing means, thus permitting comparatively light and therefore less bulky biasing means than in the prior art. This accomplishes a two fold advantage over the prior art devices in that the overall weight of the binding is reduced and the manufacturing costs are reduced. Moreover, devices for adjusting the tension of the biasing means may be manufactured to a smaller size thus achieving an advantage of being less cumbersome to use.

SUMMARY OF THE INVENTION

In the ski binding according to the present invention the holding member is integral with a movable member supported by a toggle arrangement and is displaceable in relation thereto against the action of a biasing means such as a compression spring. The toggle is articulated to the ski or intermediate plate by way of a generally U - shaped traction stirrup embracing the end of the boot sole, the free ends of said stirrup being articulated to the ski or plate around a first axis transverse to the ski and parallel to the upper face thereof, the second end of the stirrup being articulated to the toggle around a second axis parallel to the first and in fixed position in relation to the toggle. The sole holding member, during skiing, is situated beneath the plane of traction of the stirrup. In such manner the sole hold, when released, is displaceable in a direction tending to bring it closer to the toggle along a trajectory secant to the toggle, the movable member having a cam with which the biasing means cooperates to restrain such displacement.

According to one embodiment of the invention, the sole hold consists of the end of a lever pivoted on the toggle around an axis in fixed position in relation to the toggle. Another portion of the lever, nearer to the axis, supports the cam cooperating with the biasing means.

According to another embodiment of the invention, the sole hold consists of one end of a plunger slidable in the toggle. The trajectory of the plunger is secant to that of the biasing means supported by the toggle and the other end of the plunger bears the cam cooperating with the biasing means.

According to a further embodiment, the position of the second axis of the stirrup and the arrangement of the movable member in relation to said axis are such that upon release, the trajectory of the sole hold cuts the plane of traction of the stirrup and passes above such plane.

In yet another embodiment, the trajectory of the sole hold remains below the plane of traction of the stirrup.

In accordance with the present invention, the support for the ski boot sole may consist either of the ski itself or of a plate secured to the ski on which it is, for example, pivotally or slidably mounted, the plate extending beneath at least a portion of the sole. It is presently preferred to utilize the binding of the invention in conjunction with a sole-plate which, itself, is capable of detaching from the ski for release, such as the type of binding sold under the trademark BURT. In such instance the device of the invention constitutes a second safety device serving to attach the boot to the plate and preferably comprises the heel latch.

Those skilled in the art will appreciate that the release device of the invention is equally applicable for engaging the toe or the heel of the ski boot. Moreover, the traction stirrup may consist of rigid members or flexible members such as metal cables and the biasing means described herein may be arranged to act in compression or in tension.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

BRIEF DESCRIPTION OF THE DRAWINGS

Certain specific embodiments of the invention have been chosen for purposes of illustration and description, and are shown in the accompanying drawings, forming a part of the specification wherein:

FIG. 3 illustrates the embodiment of FIG. 1, in sectional view, at the conclusion of release;

FIG. 4 is a side view of the embodiment of FIG. 1 as it is being latched;

With reference to FIGS. 1 to 4, numeral 1 indicates the sole of the heel of a ski boot shown in phantom which is held on a support consisting, in this example, of a ski 2. The boot is held against the ski by a sole holding member 3 shaped to cooperate with the upper edge of the sole 1. The sole holding member 3 is integral with a movable member consisting of a lever 4 supported by a toggle housing 5 to which it is pivoted around a shaft 6. The upper surface of lever 4 defines a cam 7 and a portion 8 having a recessed contour in which is partially lodged, during the skiing phase, the matching end contour 9 of a plunger 10. The contoured end 9 tends to be held constantly bearing against the contoured portion 8 by a compression spring 11 housed in a lengthwise recess 12 in the toggle housing 5. The contour of the cam 7 is sufficiently inclined so that there is a ratio greater than 1 between the release effort serving to free the boot in direction 20 and the opposing stress of spring 11.

Figure 1:
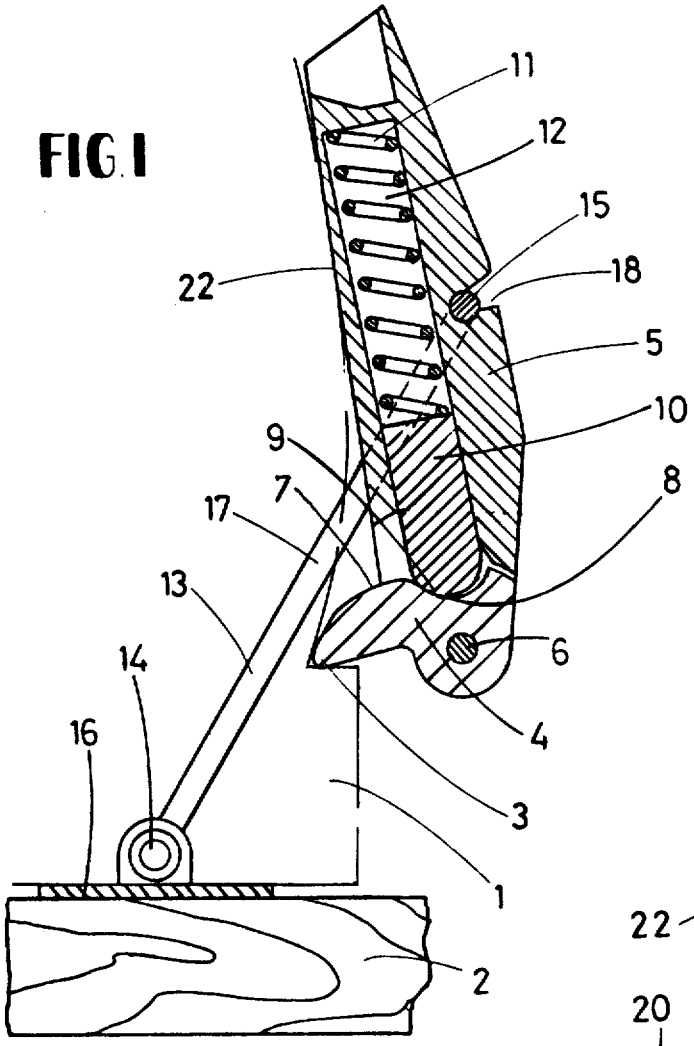
FIG. 1 illustrates one embodiment of the binding of the present invention taken in sectional view, in the skiing position.

The toggle housing 5 is articulated to the ski 2 by way of a traction stirrup 17 embracing the end of the sole 1. The stirrup has two arms 13 (one not shown) the ends of which are articulated to the ski 2 on a first axis 14 by inwardly bent extensions pivotally supported in upstanding ears of a support plate 16 which is secured to the top of ski 2. This first axis 14 is arranged transverse to the ski 2 and parallel to the top face thereof. The closed end of stirrup 17 is articulated to the toggle housing 5 on a second axis 15 parallel to the first and in fixed position in relation to the toggle housing 5. The axis 15 may, for example, consist of a bridge connecting arms 13, being lodged in a snap-type recess 18 in the toggle housing 5, where it is locked into place.

In its operative skiing position, the several elements of the binding occupy the positions represented in FIG. 1. The boot-engaging section 3 has a purchase on the edge of the sole 1 beneath the plane of traction of the stirrup 17, said plane passing through the two axes 14 and 15. The tension of spring 11 keeps the plunger 10 bearing against the contour of cam 7, the plunger 10 being partially into the concave portion 8 of lever 4. The toggle housing 5 bears against the ski boot upper shown in phantom at 22.

Figure 2:
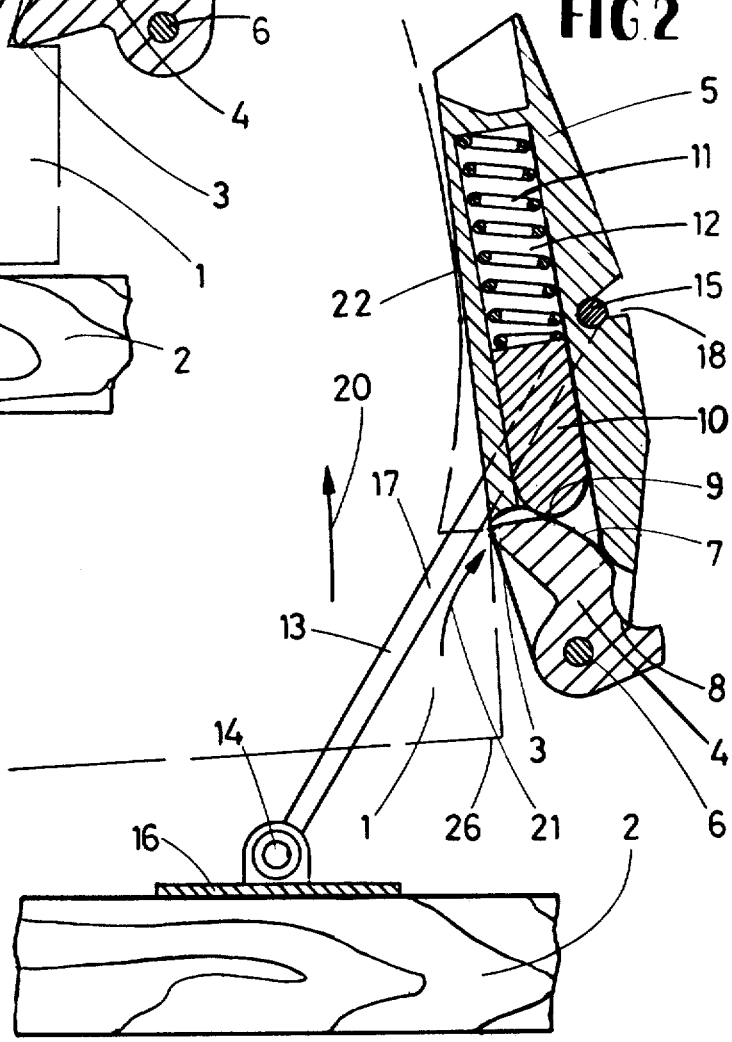
FIG. 2 illustrates the embodiment of FIG. 1, in sectional view, during release.

When a predetermined minimum stress is exerted, for example, in the direction indicated by arrow 20 in FIG. 2, by the sole 1, the lever 4 is displaced in the direction indicated by arrow 21 against the action of spring 11, thrusting plunger 10 against cam section 7. The position of the axis 15 and the situation of lever 4 in relation to axis 15 are such that the trajectory of the end of the sole holding member 3 remains beneath the plane of traction of stirrup 17. The sole hold 3 thus travels in a direction tending to bring it closer to the toggle 5 until it is completely withdrawn into the toggle housing 5, as shown in FIG. 2.

The boot is then able to continue its displacement in the direction of arrow 20, the upper 22 sliding along the toggle housing 5 to complete the release of the boot from the binding and ski. As soon as the bottom edge 26 of sole 1 passes the sole holding member 3, the latter is free to travel in direction of arrow 29 (FIG. 3) under the action of plunger 10 propelled by spring 11, finally occupying the position of FIG. 3, where the plunger 10 is fully lodged in recess 8. In this position, a safety release of the ski boot has been effected and the binding elements are automatically positioned for re-engagement with the ski boot sole.

To refasten the binding, the sole 1 of the ski boot is positioned on ski 2, and the holding member is brought over the edge of the sole 1 as shown in FIG. 4. Then toggle housing 5 is shifted in the direction of arrow 31 until it rests against the top of the boot. All members then again occupying the position of FIG. 1.

Figure 5:
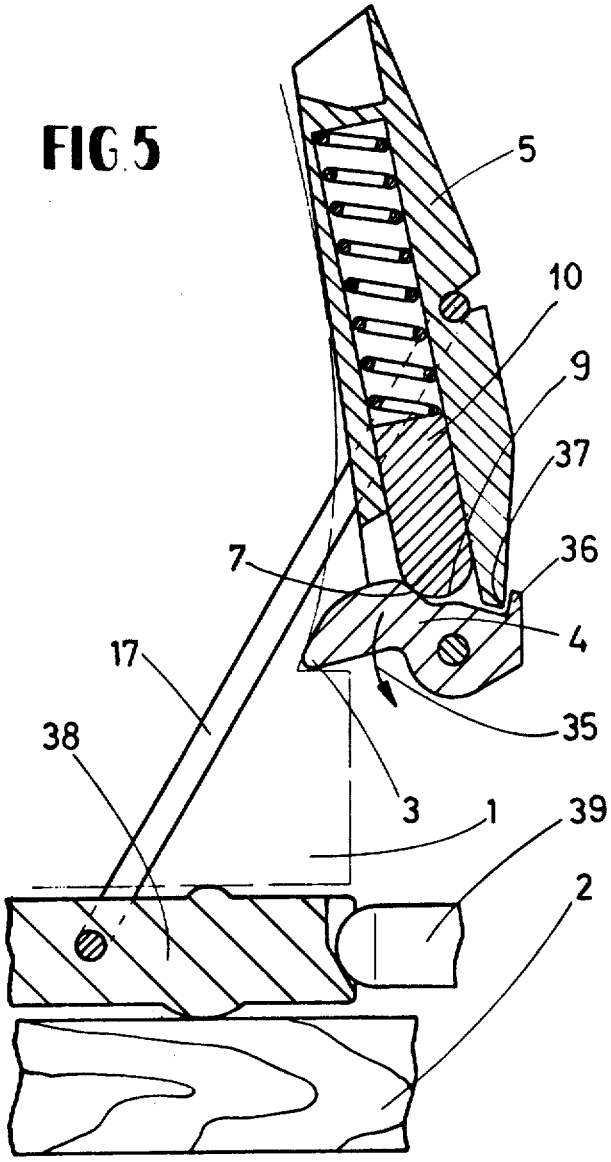
FIG. 5 is a sectional view of a first modification of the embodiment of FIG. 1.

FIG. 5 shows a modification of the embodiment previously described. In this modification, the lever element 4 is contoured so that the end 9 of plunger 10 constantly bears upon the contour of cam 7 thus tending to rotate it in the direction of arrow 35. The fixed position of the sole holding member 3 in relation to the toggle housing 5 is secured by two stops 36 and 37 arranged opposite to each other respectively on the lever 4 and on the toggle housing 5 to limit the rotation of lever 4 in the direction of arrow 35.

As illustrated in FIG. 5, the support comprises a sole-plate 38 to which is articulated the stirrup 17 serving to place the boot-engaging section 3 on the sole 1, and accordingly the sole 1 on the plate 38. In this example, the sole-plate 38 is a release plate held to the ski chiefly by an elastic pawl 39, of known construction, from which it will be released when a predetermined minimum separating force is exerted between the plate 38 and the ski 2. Therefore, the binding of the invention forms a second safety release device of a kind to act in case of especially severe falls after release of the plate 38, when the latter remains attached to the ski 2 by a run-away strap or the like.

Figure 6:
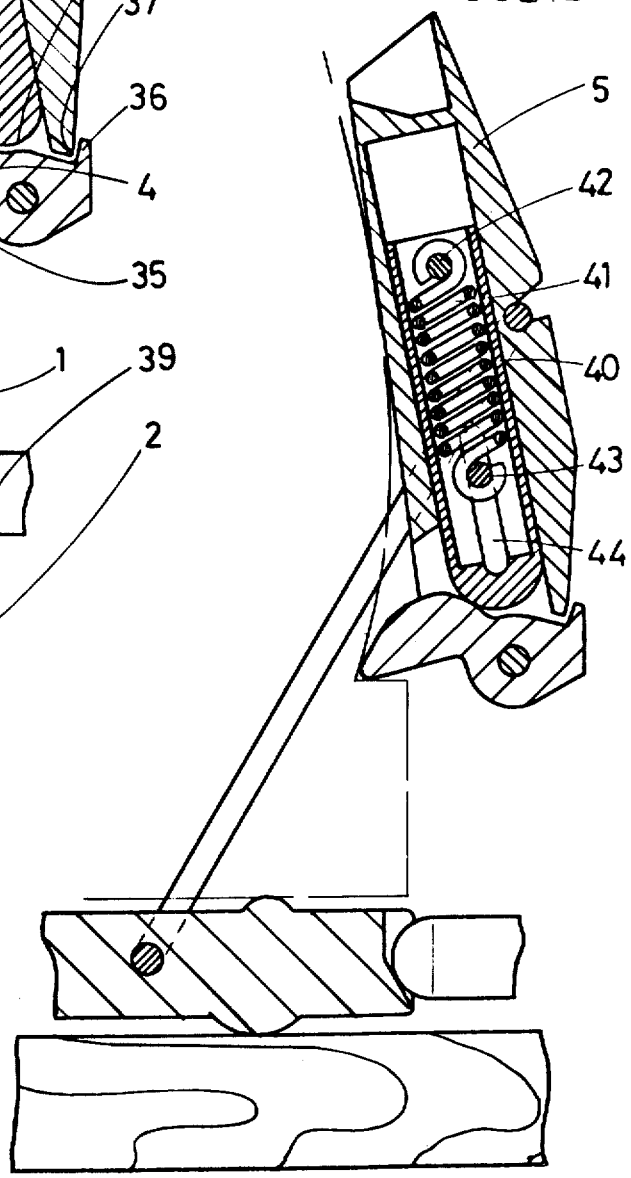
FIG. 6 is a sectional view of a second modification of the embodiment of FIG. 1.

FIG. 6 shows a modification of the embodiments previously described. In this modification, the solid plunger 10 and the compression spring 11 are replaced by a hollow piston 40 in which is housed a tension spring 41 hooked at one end to a shaft 42 integral with the piston 40 and at the other end to a shaft 43 integral with the toggle housing 5. Apertures 44 are provided through which shaft 43 extends to permit lengthwise displacement of the piston 40. All the other parts are the same as in the embodiment of FIG. 5 and the mode of operation is the same as in the embodiments previously described.

Figure 7:
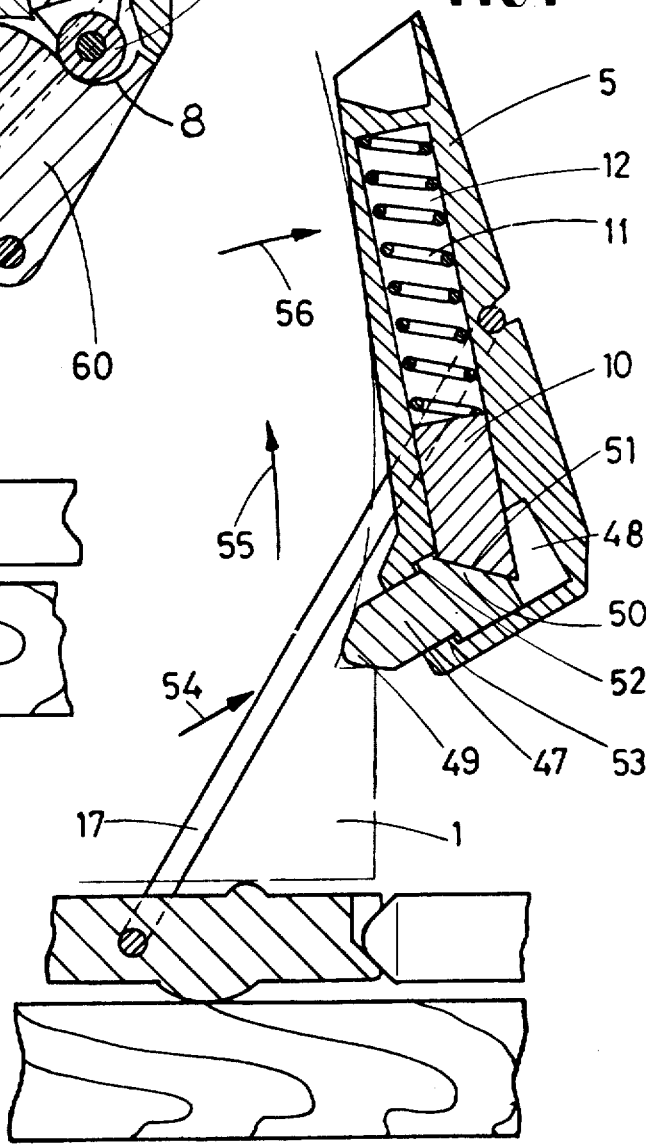
FIG. 7 is a sectional view of a second embodiment of the invention.

In the embodiment of FIG. 7, the pivoted lever 4 of the embodiments previously described is replaced by a plunger 47 slidable within the toggle housing 5 in a recess 48 the lengthwise axis of which is secant to that of the recess 12. One end of plunger 47 forms a boot-engaging section 49, and the other end bears an inclined cam 50 arranged to engage a corresponding face 51 of plunger 10. The toggle housing 5 and the plunger 10 have cooperating shoulders 52 and 53 which limit the extension of plunger 10 from recess 48. Upon release, plunger 47 travels in the direction of arrow 54, its boot-engaging section 49 remaining beneath the plane of traction of stirrup 17 until it has been withdrawn into the toggle housing 5. The sole 1 is then free to travel upward in direction of arrow 55 for full release. The plunger 47 is then free to resume an equilibrium position in which the shoulders 52 and 53 bear against each other.

Without departing from the scope of the present invention, the trajectory of the plunger 47 might be arranged so that, upon release, the sole holding member 49 cuts the plane of traction of stirrup 17 and passes above said plane. In such case, the sole 1 would be released by a sudden rotation in direction of arrow 56 of the entire toggle housing 5 as soon as the sole holding member 47 passes above the plane of traction of stirrup 17, without requiring any full retraction of the sole holding member 49 into the toggle 5.

Figure 8:
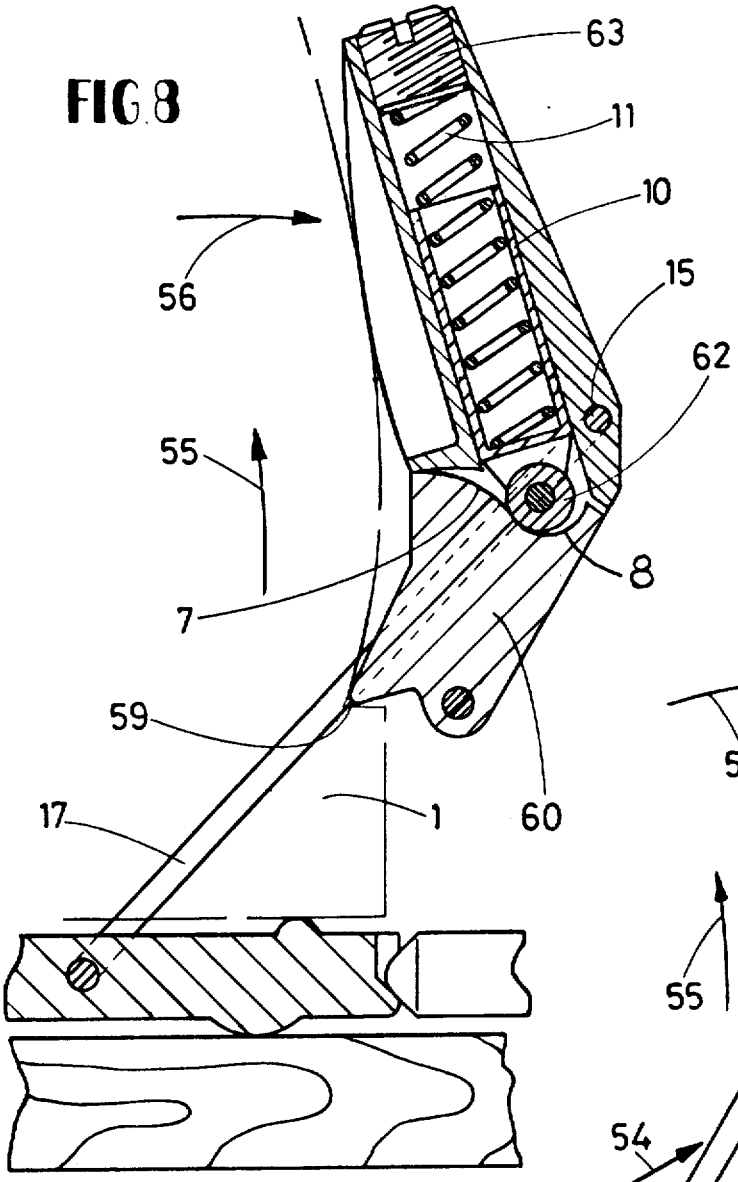
FIG. 8 is a sectional view of a third embodiment of the invention.

FIG. 8 represents a third embodiment of the present invention in which a boot-engaging section 59 is carried by a lever 60 pivoted at is lower extremity to the toggle housing. The position of the axis 15 of stirrup 17, and the arrangement of lever 60 in relation to the axis 15 are such that upon release, the trajectory of the sole holding member 59 cuts the plane of traction of stirrup 17 and passes above said plane. The other elements of the device are substantially the same as those of the first embodiment previously described. However, a roller 62 is added at the end of the piston 10 in which is lodged the compression spring 11, and an adjustment screw 63 is threaded to the top of toggle housing 5 and bears against spring 11. By adjusting screw 63 the compression of spring 11 and tension of plunger 10 may be altered to change the release characteristics of the binding. In this embodiment, also the axis 15 between the traction stirrup 17 and toggle housing 5 is formed by a channel formed in toggle housing 5 through which passes the closed end of stirrup 17. For release, as soon as the sole holding member 59 passes above the plane of traction of the stirrup 17, the toggle housing 5 suddenly swings bodily in direction of arrow 56, and the sole 1 is free to move in direction of arrow 55. The plunger 10 acts at once on cam 7 to bring the roller 62 into the recess 8, and the safety fastening is thus ready for reattachment.

Although not shown, those skilled in the art will appreciate that the tension adjustment screw 63 illustrated in FIG. 8 may also be used for the embodiment of FIGS. 1 through 7.

What is claimed is:

1. A safety ski binding for holding a ski boot to a support and permitting separation thereof upon a minimum predetermined separating force which comprises:

a generally U-shaped stirrup;

means pivotally mounting the free ends of said stirrup to said support, said stirrup adapted to be rotatable about a first axis transverse to said support and parallel to the upper face thereof, said stirrup being constructed and arranged to encircle an end of said ski boot when positioned on said support;

a toggle pivotally mounted to the closed end of said stirrup and adapted to be rotatable relative to said stirrup about a second axis parallel to said first axis;

a holding member movably mounted to said toggle between said first and second axes, said holding member having a boot-engaging section adapted to engage a portion of the sole of said ski boot to maintain said boot in position on said support;

biasing means housed within said toggle for urging said boot-engaging section of said holding member into a boot-engaging position, said boot-engaging section being movable in a direction toward said toggle and against the action of said biasing means to release said ski boot upon application of said minimum separating force; and a cam section on said holding member operatively associating said biasing means and said boot-engaging section whereby the boot holding force of said binding is greater than the elastic force of said biasing means.

2. A safety ski binding according to claim 1 wherein said support is a plate fixed to a ski, said plate having lateral upstanding ears to which the free ends of said stirrup are pivotally mounted.

3. A safety ski binding according to claim 1 wherein said support is a sole-plate adapted to be positioned intermediate said ski boot and a ski.

4. A safety ski binding according to claim 1 wherein said holding member comprises a lever pivoted to said toggle to rotate about an axis between and parallel to said first and second axes, and said cam section is formed on the upper surface of said lever between said boot-engaging section and the axis of rotation between said lever and said toggle.

5. A safety ski binding according to claim 4 wherein said biasing means comprises a compression spring bearing against a plunger, said plunger having a contoured end engaging said cam section for cooperation therewith to urge said boot-engaging section into boot-engaging position.

6. A safety ski binding according to claim 1 which further includes means for adjusting the tension of said biasing means and stop means on said holding member limiting the travel of said boot-engaging section away from said toggle.

7. A safety ski binding according to claim 1 wherein said holding member comprises a plunger slidable in a housing in said toggle along a path secant to said biasing means, one end of said plunger having an inclined face defining said cam section and the other end of said plunger defining said boot-engaging section.

8. A safety ski binding for releasably holding a ski boot to a ski which comprises:

a sole-plate positionable between said ski boot and said ski;

means for releasably securing said sole-plate to the surface of said ski;

means for releasably securing a ski boot to said sole plate which comprises a generally U-shaped stirrup mounted to said plate to pivot about a first axis transverse to said plate and parallel to the upper face thereof, said stirrup being constructed and arranged to encircle the heel end of said ski boot when positioned on said plate; a toggle pivotably mounted to the closed end of said stirrup and adapted to rotate about a second axis parallel to said first axis, a holding member pivotally mounted to said toggle and adapted to rotate about an axis parallel to and between said first and second axes, said holding member having a boot-engaging section adapted to engage a portion of the sole of said ski boot to maintain said boot in position on said sole-plate, and biasing means housed within said toggle for urging said boot-engaging section of said holding member into a boot-engaging position, said boot-engaging section being displaceable against the action of said biasing means to release said ski boot upon application of a predetermined minimum separating stress, said holding member having a cam section operatively associating said biasing means and said boot-engaging section whereby the boot holding force of said binding is greater than the elastic force of said biasing means.

* * * * *